United States Patent [19]

Milton

[11] 3,956,963

[45] May 18, 1976

[54] MUSICAL ATTACHMENT FOR GUITAR

[76] Inventor: John L. Milton, 554 - 55th St., Delta, British Columbia, Canada, V4M 3J7

[22] Filed: Feb. 24, 1975

[21] Appl. No.: 552,137

[52] U.S. Cl. ..... 84/296
[51] Int. Cl.[2] ..... G10D 3/02
[58] Field of Search ..... 84/294, 296, 453, 270

[56] References Cited

UNITED STATES PATENTS

| | | | |
|---|---|---|---|
| 1,348,652 | 8/1920 | Lange | 84/296 |
| 3,233,495 | 2/1966 | Bernardi | 84/294 |
| 3,457,820 | 7/1969 | Snider | 84/296 |
| 3,623,390 | 11/1971 | Pitt, Jr. | 84/294 |

*Primary Examiner*—Stephen J. Tomsky

[57] ABSTRACT

This invention relates to musical instruments and in particular to attachments for application to guitars to change the tone of the latter.

8 Claims, 4 Drawing Figures

MUSICAL ATTACHMENT FOR GUITAR

BACKGROUND OF THE INVENTION

Prior Art

Conventionally, attachments for musical instruments are simply used for altering their tone sufficiently to obtain a special effect which is unique to that instrument itself, for example, violin mutes and vibrato arms for guitars. Few attachments alter the tonal characteristics of a particular instrument sufficiently so that it resembles an instrument having different tonal qualities.

In general, a guitarist of average ability is not necessarily familiar with the tuning sequence or scale positions of other stringed instruments, for example, a banjo.

The principal objects of this invention are:

Firstly, to enable the guitarist, who is competent only in the chord and scale arrangements of a guitar, to provide a greater variety in his performance by imitating the sound of a banjo.

Secondly, to enable the guitarist of any degree of skill to produce a banjo tone or the guitars original tone using only a single instrument with attachment and without the expense of purchasing a second instrument.

Thirdly, to raise the volume of the guitar by adding an additional resonator, namely the stretched skin of the attachment.

Summary of Invention

The present invention provides an attachment for guitars which so alters the tonal characteristics of a guitar so that it resembles a banjo.

The attachment of the present invention includes an annular frame over which a transparent light-weight skin is stretched and which is held in position over, and clear of, the strings of a guitar by suction cups which engage the face of the guitar body. A hard plastic bridge, which is held in place by means of a thin rigid wire passing through it, is positioned at the underside of the skin and on top of the strings of the guitar, just ahead of the guitar bridge so that the string vibrations are transmitted through the attachment bridge to the skin.

The invention is quickly detached by pulling one of the protruding tabs of the suction cups to allow the air to enter under the cups and so remove the vacuum.

A detailed description following, related to the drawings, gives exemplification of apparatus according to the invention which, however, is capable of expression in means other than those particularly described and illustrated.

DESCRIPTION OF THE DRAWINGS

In the drawings which illustrate one embodiment of the invention -

DETAILED DESCRIPTION

Figure 1:
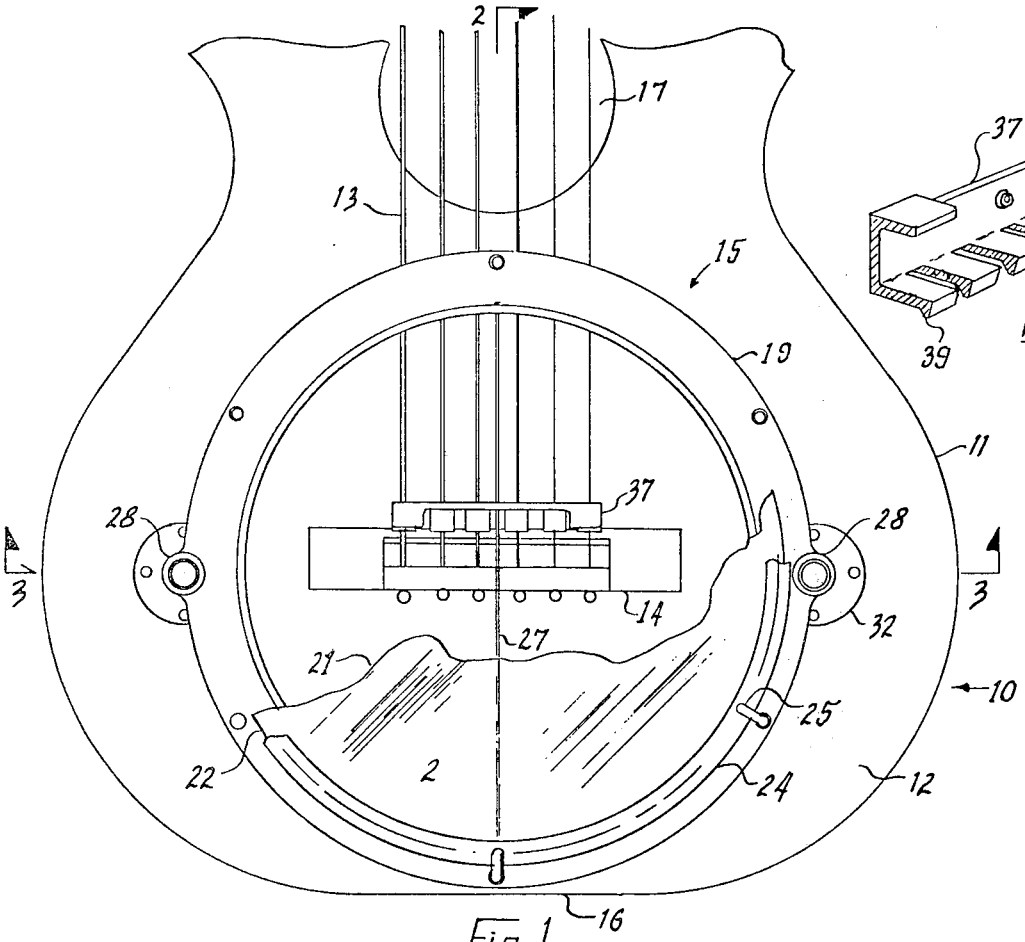
FIG. 1 is a plan view of a guitar, shown partially only, with attachment of the invention in place.
Figure 4:
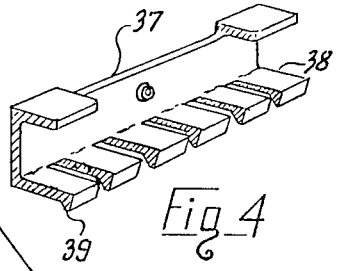
FIG. 4 is an isometric view of the bridge showing the 6 tongues and their downward pointing lips.
Figure 2:
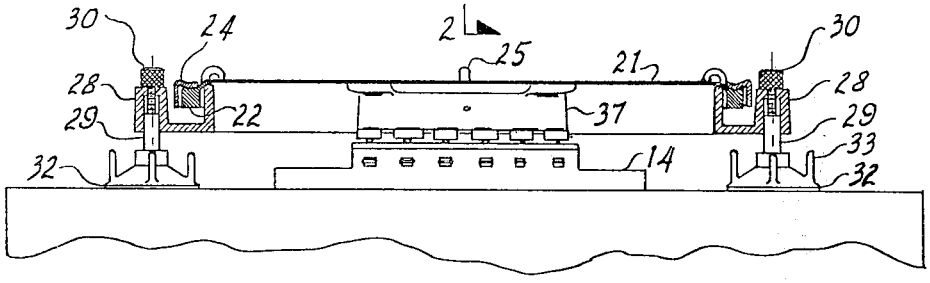
FIG. 2 is a section taken on line 2—2 of FIG. 1.
Figure 3:
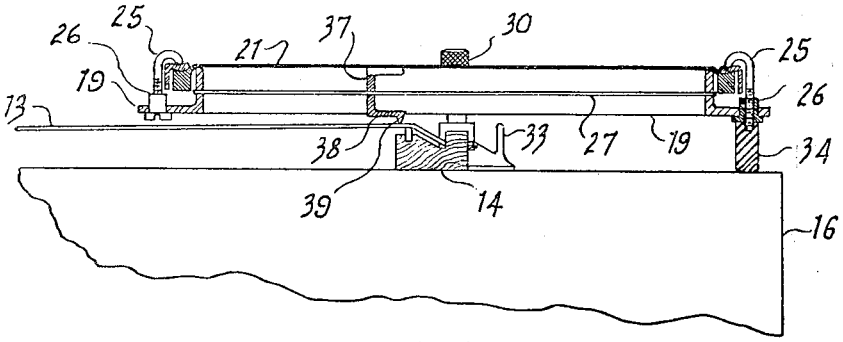
FIG. 3 is a section taken on line 3—3 showing the method of adjusting the tension of the attachment to the guitar. Also shown are the quick release tabs on the suction cup.

Referring to the drawings, the numeral 10 designates a guitar which, conventionally, has a body 11 having a flat face 12 and strings 13 which extend over a bridge 14. The attachment 15 of the present invention is positioned over the strings between the guitar base 16 and the conventional opening 17.

The attachment 15 has an annular, angle shaped supporting ring 19, over which a thin transparent plastic skin 21 is stretched. The peripheral marginal portion of the skin is cemented into a U-shaped annulus 22. An annular clamping ring 24 located on and around the U-shaped annulus 22, clamps the skin against the main support ring 19.

Six hook screws 25 which hook into the recessed section of ring 24 have a threaded connection with the T-shaped nuts 26 extending upward through the supporting ring 19. The skin, as is evident, can be adjusted for tension by suitable adjustment of the T-nuts 26.

The supporting ring 19 has a pair of diametrically opposed side brackets 28-28 with which internally threaded adjusting posts 29-29, and knurled adjustment knobs 30-30, have a screw connection. Rubber suction cups 32-32 are secured at the lower ends of the adjusting posts 29-29.

A resilient adjustable supporting block 34 is secured to the supporting ring 19 at the circumference, equidistantly between the side flanges 28 and perpendicular to an imaginary line joining the flanges 28 - 28.

A hard plastic bridge 37 is affixed in a position equidistant between flanges 28-28 and on the opposite side of the imaginary line joining them to the support block 34, so that the line joining the flanges 28-28 lies between the bridge and the support block. A thin rigid wire 27, namely a piano wire, passes perpendicularly through the bridge and is affixed to the circumference of the support ring 19 at one side at the same position as the support block 34 and at the diametrically opposite side, so that it forms a perpendicular line to the imaginary line joining flanges 28-28. The bridge 37 is channel shaped with the bottom flange divided into six tongues 38 protruding from the web of the bridge. Each tongue is allowed to flex independently and has a downward pointing triangular shaped lip 39 that when pressed against the strings of the guitar, automatically compensate for any thickness variations of the strings and will accordingly match the contour of a rounded guitar bridge, should one be so fitted.

As illustrated in the drawings, the attachment 15 is firmly secured to the face of the guitar by the suction cups 32 with the tongue edges 39 of the bridge 37 positioned slightly ahead of the bridge 14.

The suction cups 32 have four tabs 33 protruding from the topside and outer edge of the cups to provide for an easy release of the cups when pulled.

It is seen that the bridge 37, the supporting block 34 and the suction cups 32, provide a four point support for the attachment.

Pressure of the bridge 37 on the guitar strings can be adjusted by appropriate adjustment of the knurled screws 30-30.

I claim:

1. An attachment for a musical instrument having a sound box fitted with a bridge supporting strings near ends thereof; said attachment comprising a ring defining an opening, a resonator of sheet material secured to the ring and stretched taut across the opening, securing means for attaching the ring to the sound box to position the resonator above the bridge, a wire secured to the ring and extending across the opening beneath the resonator, and a bridge piece supported by the wire, said bridge piece having a first portion engaging the strings of the instrument and a second portion in contact with the resonator.

2. An attachment as claimed in claim 1, in which said securing means comprises suction cups, said suction cups each having at least one pull tab near a peripheral edge thereof.

3. An attachment as claimed in claim 1, and including adjustable means for securing the resonator to the ring whereby the tautness of the sheet material can be selectively adjusted.

4. An attachment as claimed in claim 1, and including a resilient block secured to the ring for engagement with the sound box at a point near an end of the wire.

5. An attachment as claimed in claim 1, in which said first portion of the bridge piece comprises a plurality of flexible tongues individually engaging the strings of the instrument.

6. An attachment as claimed in claim 5, in which each of said tongues has a triangular lip engaging a string of the instrument.

7. An attachment as claimed in claim 6, in which said securing means comprises suction cups, and a resilient block secured to the rings for engagement with the sound box at a point near an end of the wire.

8. An attachment as claimed in claim 7, in which said suction cups each have at least one pull tab near a peripheral edge thereof, and adjustable means for securing the resonator to the ring whereby the tautness of the sheet material can be selectively adjustable.

* * * * *